United States Patent [19]

Lenz et al.

[11] 4,009,563

[45] Mar. 1, 1977

[54] APPARATUS FOR FALSE-TWISTING SYNTHETIC FILAMENT YARNS

[75] Inventors: Hans Lenz, Dormagen; Edgar Muschelknautz, Leverkusen; Heiko Herold, Dormagen; Kurt Bernklau, Dormagen; Lutz Georgias, Dormagen, all of Germany

[73] Assignee: Bayer Aktiengesellschaft, Leverkusen, Germany

[22] Filed: Oct. 30, 1974

[21] Appl. No.: 519,302

[30] Foreign Application Priority Data

Nov. 10, 1973 Germany ..... 2356220

[52] U.S. Cl. ..... 57/77.3; 57/157 F

[51] Int. Cl.[2] ..... D02G 1/16

[58] Field of Search ..... 57/77.3, 77.45, 34 R, 57/34 B, 157 F

[56] References Cited

UNITED STATES PATENTS

| | | | |
|---|---|---|---|
| 2,515,299 | 7/1950 | Foster et al. | 57/77.3 |
| 3,079,745 | 3/1963 | Breen et al. | 57/77.3 X |
| 3,094,374 | 6/1963 | Smith | 57/77.3 X |
| 3,448,500 | 6/1969 | Benson | 57/157 F X |
| 3,479,707 | 11/1969 | Loveland | 57/34 B X |
| 3,636,694 | 1/1972 | Pfunder et al. | 57/77.3 |
| 3,802,174 | 4/1974 | Landwehrkamp et al. | 57/77.3 X |

*Primary Examiner*—Donald E. Watkins
*Attorney, Agent, or Firm*—Burgess, Dinklage & Sprung

[57] ABSTRACT

This invention relates to an apparatus for false twisting synthetic filament yarns, which apparatus is in the form of an air rotated nozzle having tangential inlet bores and two central outlet bores. The twisting chamber is set at an angle of 2° to 40° to the draw-off direction of the filament. The special advantage of this apparatus according to the invention is that it ensures smooth movement of the filament outside the twisting chamber.

11 Claims, 2 Drawing Figures

APPARATUS FOR FALSE-TWISTING SYNTHETIC FILAMENT YARNS

Figure 1:
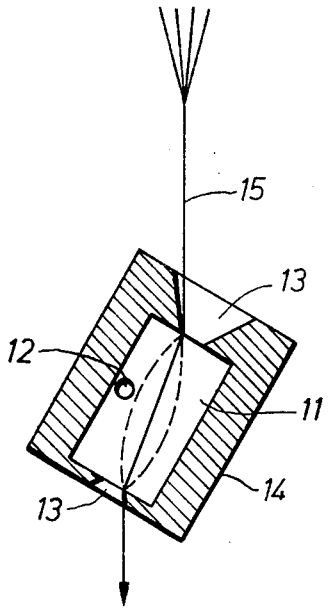

The invention relates to an apparatus for false twisting yarns, such as synthetic filament yarns.

It is known that such rotation nozzles can be used to impart a false twist to synthetic filament yarns. In the rotation nozzles hitherto known, however, it has been found that the filament which is pressed against the internal wall of the nozzle by centrifugal force and rolls or slides off this wall is subjected to powerful frictional forces. The rotational movements of the filament inside the nozzle are propagated upstream and downstream of the nozzle so that the movement of the filament is restless. It is therefore difficult to apply lubricants to the filament immediately after it has been false-twisted.

It is an object of this invention to provide an apparatus which will twist a filament without much friction and enable the filament to move smoothly above and below the apparatus. According to the invention, there is provided an apparatus for false twisting yarns, comprising a cylindrical twisting chamber, having one or more tangential inlet bores and two axial bores, wherein the axis of the twisting chamber is arranged at an angle of 2° to 40° to the take-off direction of the filament.

The main advantages achieved with this apparatus according to the invention consist in enabling synthetic filaments to be twisted while maintaining a smooth movement of the filaments outside the apparatus. The dimensions of the rotation nozzle ensure that very high air velocities prevail at the periphery of the outlet bore while only low air velocities occur in the centre of the bore. The filament is thereby blown away from the wall with the result that it is subjected to much less friction than it would be if it ran in contact with the wall.

According to a preferred feature of the apparatus according to the invention, the two outlet bores have the same diameter. This has the result that the air introduced into the nozzle escapes through both outlet bores and the friction exerted on the filament at the edges of the false twisting appartus is thereby reduced.

According to a further preferred feature of the apparatus of the invention, exceptionally smooth movement of the filament and efficient twisting are achieved by making the height of the twisting chamber equal to 3 to 12 times, preferably 5 to 7 times, and the diameter of the twisting chamber 2 to 6 times, preferably 3 to 4 times, the diameter of the outlet bores.

Another embodiment of the apparatus according to the invention is characterised in that the surface area of the tangential inlet bores is ⅓ to 1/15, preferably 1/6 to 1/12, that of the outlet bores. This arrangement ensures that the synthetic filament yarns will be sufficiently twisted with relatively little consumption of air and the circumferential velocity will be so high that the filament will be blown away from the wall of the twisting chamber and consequently the friction on the filament will be substantially lower than that exerted on a filament which rolls off the internal surface of the twisting chamber.

Experiments have shown that the airflow is radial at one outlet but set at a certain angle at the other outlet. Although these flow angles can be altered by external influences, the situation never arises that the flow is radial at both outlets or oblique at both outlets. It has also been found that the movement of the filament is smooth if the flow of gas is radial at the outlet from which the filament leaves the chamber. This smooth movement of the filament is ensured by another feature of the apparatus according to the invention, which consists in that the outlet aperture through which the filament is fed into the chamber is in the form of a funnel with an opening angle of between 40° and 150°, preferably 70° to 120°.

A preferred example of the apparatus according to the invention is illustrated in the drawings and described below.

Figure 2:
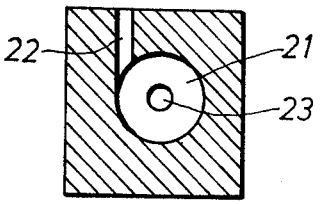

In the drawings:

FIG. 1 shows a longitudinal section through an apparatus according to the invention and FIG. 2 shows a cross-section through an apparatus according to the invention.

FIG. 1 shows an inlet bore 12 which enters a spinning chamber 11 tangentially and through which air is injected, and two axial outlets 13, through one of which a synthetic filament yarn 15 enters the chamber and through the other of which it leaves. The axial outlet 13 through which the filament 15 enters the chamber 11 is funnel-shaped.

FIG. 2 shows a cross-section through the apparatus according to the invention illustrating the tangential entry of an inlet bore 22 into a chamber 21 and central outlets 23.

What we claim is:

1. An apparatus for false twisting yarns moving in a take-off direction, comprising a cylindrical twisting chamber, having one or more tangential inlet bores for injection of air, and two axial bores for, respectively entry of yarn into the twisting chamber and leaving of the yarn from the twisting chamber, wherein the axis of the twisting chamber is arranged at an angle of 2° to 40° to the take-off direction of the filament.

2. An apparatus as claimed in claim 1, wherein the axis of the twisting chamber is arranged at an angle of 8° to 20° to the take-off direction of the filaments.

3. An apparatus as claimed in claim 1, wherein the two axial bores have the same diameter.

4. An apparatus as claimed in any preceding claim 3, wherein the height of the twisting chamber is 3 to 12 times, and the diameter of the twisting chamber is 2 to 6 times, the diameter of the axial bores.

5. An apparatus as claimed in any preceding claim 1, wherein the surface area of the tangential inlet bores is ⅓ to 1/15, of the surface areas of the two axial bores.

6. An apparatus as claimed in claim 1, wherein the axial bores through which the filament enters the chamber is a funnel with an opening angle of between 40° and 150°.

7. An apparatus as claimed in claim 3, wherein the height of the twisting chamber is 5 to 7 times, the diameter of the twisting chamber is 3 to 4 times the diameter of the axial bores.

8. An apparatus as claimed in claim 1, wherein the surface area of the tangential inlet bores is 1/6 to 1/12 of the surface areas of the axial bores.

9. An appartus as claimed in claim 1, wherein the axial bore through which the filament enters the chamber is a funnel with an opening angle of between 70° and 120°.

10. An apparatus as claimed in claim 3, wherein the height of the twisting chamber is 3 to 12 times, and the diameter of the twisting chamber is 2 to 6 times the diameter of the axial bores, and the surface area of the tangential inlet bores is ⅓ to 1/15 of the surface areas of the axial bores, and the axial bore through which the filament enters the chamber is a funnel with an opening angle of between 40° and 150°.

11. Method of false twisting yarns and thereafter applying a lubricant thereto, which comprises imparting a false twist to the yarn with apparatus for false twisting yarns moving in a take-off direction, comprising a cylindrical twisting chamber, having one or more tangential inlet bores for injection of air, and two axial bores for, respectively entry of yarn into the twisting chamber and leaving of the yarn from the twisting chamber, wherein the axis of the twisting chamber is arranged at an angle of 2° to 40° to the take-off direction of the filament, and applying a lubricant to the yarn immediately after it is false twisted by said apparatus.

* * * * *

UNITED STATES PATENT AND TRADEMARK OFFICE

CERTIFICATE OF CORRECTION

PATENT NO. : 4,009,563

DATED : March 1, 1977

INVENTOR(S) : Hans Lenz, Edgar Muschelknautz and, Heiko Herold

It is certified that error appears in the above-identified patent and that said Letters Patent are hereby corrected as shown below:

Column 2, line 42, (claim 4, line 1), cancel "any preceding".

Column 2, line 46, (claim 5, line 2), cancel "any preceding".

Column 2, line 54, (claim 7, line 2), insert "and" before --the diameter--.

Signed and Sealed this

*nineteenth* Day of *July 1977*

[SEAL]

*Attest:*

RUTH C. MASON
*Attesting Officer*

C. MARSHALL DANN
*Commissioner of Patents and Trademarks*